US005685643A

United States Patent [19]

Stary

[11] Patent Number: 5,685,643

[45] Date of Patent: Nov. 11, 1997

[54] PLASTIC BAG FOR PERSONAL-HYGIENE ARTICLES

[75] Inventor: Christof Stary, Eckental, Germany

[73] Assignee: VP-Schickedanz SA, France

[21] Appl. No.: 507,273

[22] PCT Filed: Feb. 26, 1993

[86] PCT No.: PCT/EP94/00536

§ 371 Date: Aug. 21, 1995

§ 102(e) Date: Aug. 21, 1995

[87] PCT Pub. No.: WO94/19249

PCT Pub. Date: Sep. 1, 1994

[30] Foreign Application Priority Data

Feb. 26, 1993 [DE] Germany ..... 9302821 U

[51] Int. Cl.[6] ..... B65D 33/14

[52] U.S. Cl. ..... 383/24; 383/67; 383/209; 221/45; 221/63; 206/823

[58] Field of Search ..... 206/361, 362, 206/440, 581, 823, 815, 804; 221/45, 63, 64, 65, 283; 383/24, 67, 207, 209

[56] References Cited

U.S. PATENT DOCUMENTS

| | | | |
|---|---|---|---|
| 1,890,295 | 12/1932 | Jacobs | 221/45 |
| 4,570,820 | 2/1986 | Murphy | 221/45 X |

FOREIGN PATENT DOCUMENTS

| | | | |
|---|---|---|---|
| 0410937 | 1/1991 | European Pat. Off. | 221/63 |
| 1149418 | 12/1957 | France | 221/63 |
| 1743587 | 4/1957 | Germany . | |

*Primary Examiner*—Jes F. Pascua
*Attorney, Agent, or Firm*—Laff, Whitesel, Conte & Saret, Ltd.

[57] ABSTRACT

A plastic bag for personal-hygiene articles, in particular for a stack of flexible pads, comprising a sheet-plastic tube forming an essentially cylindrical bag wall, both ends of said bag are initially closed, a suspension string located at one end and at the opposite end of said bag a frangible ring providing an opening allowing pads to be removed, the closure at the first one end being formed by a linear seam running between two diametrically opposite points on the cylindrical wall of the bag and passing through the longitudinal axis of the bag, the suspension string passing through the interior of the bag below the seam.

7 Claims, 1 Drawing Sheet

PLASTIC BAG FOR PERSONAL-HYGIENE ARTICLES

BACKGROUND OF THE INVENTION

The invention relates to a plastic bag for personal-hygiene articles, in particular for a stack of make-up removal pads, consisting of a sheet-plastic tube forming an essentially cylindrical bag wall, both of whose ends are closed, a suspension string for the bag being located at the upper end and an opening allowing pads to be removed being located preferably near the lower end.

BACKGROUND ART

A plastic bag of the generic type is known for instance from German utility model specification 17 43 587, according to which a sheet-plastic tube is provided to form a substantially cylindrical bag wall, the lower end of the sheet-plastic tube being tightly closed by corresponding doubling of the bag wall and electronic sewing of the doubled portions. Preferably, this end can be provided with an opening allowing removal in the form of prepunched perforated lines.

The other end to be opened of the known plastic bag, for instance the upper end, is provided with a bag suspension string passing through a channel formed by the edge of the tube being doubled down and welded.

This known plastic bag is disadvantageous in as much as the channel accommodating the suspension string is rather complicated to manufacture. Moreover, tightening the string will regularly produce a central hole as a result of the plastic sheet gathering, this hole opposing as hermetic as possible a closure of the plastic bag. Further, consumers will tend to open the plastic bag at the upper end by undoing the knot and the gathering, instead of using—as provided—the lower opening allowing removal.

SUMMARY OF THE INVENTION

Proceeding from the specified prior art disadvantages, it is the object of the invention to improve a plastic bag of the generic type such that, while being tight, the closing of the bag is as easy as possible and the suspension string is easy to apply.

Accordingly, the closure at the upper end of the plastic bag is formed by a linear seam running between the two diametrically opposite points on the wall of the bag through the longitudinal axis of the bag, the suspension string passing through the bag below the seam. In this construction, it is of advantage that only a single transverse seam is used, any complicated doubling of the edge of the bag and placing of the suspension string into a channel being avoided. Moreover, the plastic bag is closed except for the inlet and outlet of the suspension string, there being however the possibility to dimension these two passages such that they closely surround the suspension string, the bag virtually being tightly closed.

With the suspension string in parallel to the seam, the latter works as an additional reinforcement, any tearing of the bag material being prevented even if the suspension string is pulled vehemently. This is of advantage in particular when the plastic bag is gathered in the vicinity of the seam by means of the suspension string and when this gathering is fixed by the suspension string being knotted outside the plastic bag. Embodied like this, the plastic bag moreover gives the impression of a prior art bag so that there is no change in the appearance that consumers have become familiar with.

Further features, details and advantages of the invention will become apparent from the ensuing description of an exemplary embodiment, taken in conjunction with the drawing, in which

DESCRIPTION OF THE PREFERRED EMBODIMENT

Figure 2:
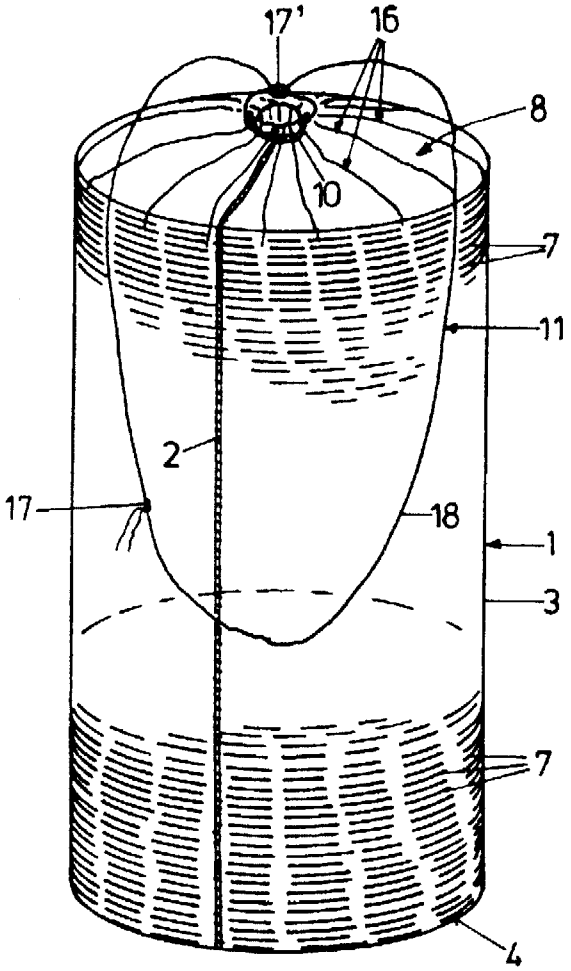
FIG. 2 is a view by analogy to FIG. 1 with the upper end of the bag gathered and the suspension string knotted.

A plastic bag according to the invention is made from a substantially rectangular sheet-plastic blank, which with the aid of a longitudinal weld, is converted into a sheet-plastic tube forming an essentially cylindrical bag wall 3. At its lower end 4, the sheet-plastic tube is closed in a fashion not shown in detail by lapping sections being doubled down and welded. The resulting bottom 5 is provided with a perforated ring 6 forming an opening allowing pads to be removed.

The plastic bag 1 serves to accommodate make-up removal pads 7, which are punched cotton rounds approximately circular in shape, outlined by dashed lines in the drawing.

Figure 1:
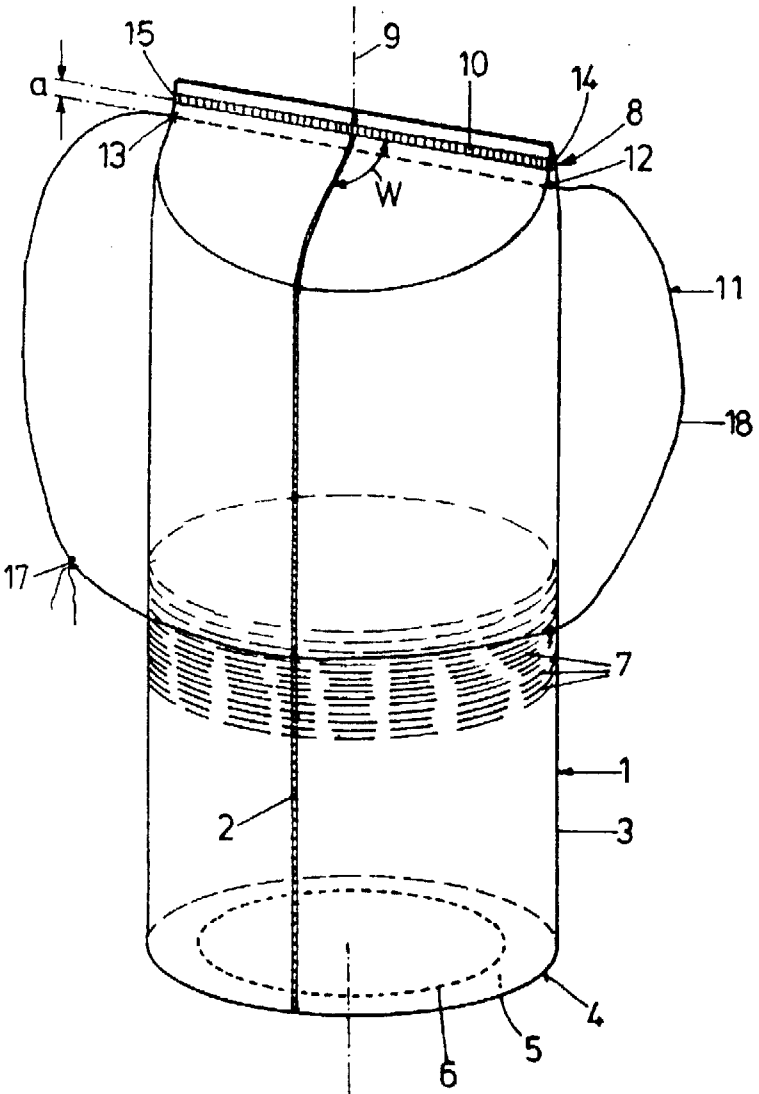
FIG. 1 is a perspective view of a closed plastic bag in an intermediate stage of manufacture.

A linear sheet weld 10 is provided at the upper end 8 of the plastic bag 1, running between two diametrically opposite points on the wall of the bag through the longitudinal axis 9 of the bag. Owing to this sheet weld 10, the upper end 8 of the plastic bag 1 has a substantially rooflike shape, as seen in FIG. 1. The sheet weld 10 extends at a right angle W to the longitudinal weld 2.

A suspension string 11 passes through the plastic bag 1 below the sheet weld 10; the configuration according to FIG. 1 shows the suspension string 11 passing through the bag substantially parallel to the sheet weld 10 and closed by a knot 17 to form a ring.

The two passages 12, 13 where the suspension string 3 penetrates the bag wall 3 are disposed at a distance a of approximately 3 mm below the two ends 14, 15 of the sheet weld 10 and closely surround the suspension string 11, since they are punched with the aid of a sort of a bearded needle while the the suspension string 11 is pulled through the bag.

Once the preparation of the plastic bag has reached the configuration according to FIG. 1, the suspension string 11 can be pulled, thus gathering the upper end 8 of the plastic bag 1 (gathering 16), as seen in FIG. 2. This gathering 16 is fixed by the knot 17' disposed outside the plastic bag 1. With the aid of the resulting loose loop 18 of the suspension string 11, the plastic bag 1 may be hung up for instance in a bathroom, the loop 18 being fit for objects of some size, for instance furniture knobs or the like.

I claim:

1. A plastic bag adapted to accommodate personal—hygiene articles, in particular a stack of flexible pads (7), said plastic bag consisting of a sheet-plastic tube forming said bag with an essentially cylindrical wall (3), said bag having a closed first end (4) and a closed second end (8), a suspension string (11) for said bag being located adjacent said second end (8) of said bag and opening means being located substantially adjacent said closed first end (4) to provide an opening for removal of said pads following opening of said opening means (6), wherein said bag includes a closure at second end (8)formed by a linear seam (10) running between two diametrically opposite points on the wail of said bag (1) through an imaginary longitudinal axis (9) of said bag, wherein said suspension string (11) passes through said bag below said seam (10) in such a manner that said suspension string (11) penetrates the bag (3) below the seam (10) from the exterior and then in the interior of said bag and exiting an opposite portion of said bag.

2. A plastic bag according to claim 1, wherein the seam (10) is a sheet weld.

3. A plastic bag according to claim 1 wherein in an ungathered condition said suspension_string (11) passes through_the said bag (1) in parallel to the said seam.

4. A plastic bag according to claim 3, wherein said seam_(10) comprises two ends (14, 15) and the suspension string (11) penetrates the wall (3) of said bag at a distance (a) of 1 to 5 mm below the ends (14,15) of said seam_(10).

5. A plastic bag according to claim 1, wherein the suspension string (11) penetrates the wall (3) of the bag by way of two passages (12, 13) which closely surround the suspension string (11).

6. A plastic bag according to claim 1, wherein in the vicinity of the seam (10), the plastic bag (1) is gathered by means of the suspension string (11) and in that the gathering (16) is fixed by means of the suspension string (11) being knotted (17) outside the plastic bag.

7. A plastic bag according to claim 1, wherein the seam (10) and a longitudinal weld (2) of the plastic bag (1) extend at right angles (W) relative to each other.

* * * * *

UNITED STATES PATENT AND TRADEMARK OFFICE

CERTIFICATE OF CORRECTION

PATENT NO. : 5,685,643

DATED : Nov. 11, 1997

INVENTOR(S) : Christof Stary

It is certified that error appears in the above-indentified patent and that said Letters Patent is hereby corrected as shown below:

On the title page: Item

[22] February 25, 1994

Signed and Sealed this

Twenty-first Day of July, 1998

*Attest:*

*Attesting Officer*

BRUCE LEHMAN

*Commissioner of Patents and Trademarks*